US007864059B2

(12) United States Patent
Lee

(10) Patent No.: US 7,864,059 B2
(45) Date of Patent: Jan. 4, 2011

(54) PORTABLE TRACKING ALARM APPARATUS

(75) Inventor: Hui-Chu Lee, Jhonghe (TW)

(73) Assignee: Micro-Star Internationa'l Co., Ltd., Jung-He (TW)

( * ) Notice: Subject to any disclaimer, the term of this patent is extended or adjusted under 35 U.S.C. 154(b) by 282 days.

(21) Appl. No.: 12/259,911

(22) Filed: Oct. 28, 2008

(65) Prior Publication Data

US 2010/0026500 A1 Feb. 4, 2010

(30) Foreign Application Priority Data

Jun. 25, 2008 (TW) ..... 97211300 U

(51) Int. Cl.

| | |
|---|---|
| ***G08B 23/00*** | (2006.01) |
| ***G08B 1/08*** | (2006.01) |
| ***A43C 11/00*** | (2006.01) |
| ***G04B 21/00*** | (2006.01) |
| ***G04F 1/00*** | (2006.01) |

(52) U.S. Cl. ..... 340/573.4; 340/539.13; 340/539.15; 24/71 R; 24/68 A; 24/68 B; 368/243; 368/327

(58) Field of Classification Search ..... None
See application file for complete search history.

(56) References Cited

U.S. PATENT DOCUMENTS

| | | | | |
|---|---|---|---|---|
| 5,905,461 | A * | 5/1999 | Neher | 342/357.54 |
| 6,388,612 | B1 * | 5/2002 | Neher | 342/357.54 |
| 6,762,685 | B2 * | 7/2004 | Muto et al. | 340/573.1 |
| 6,868,941 | B1 * | 3/2005 | Hermann | 182/3 |
| 6,989,752 | B2 * | 1/2006 | Shugrue | 340/573.1 |
| 2001/0048364 | A1 * | 12/2001 | Kalthoff et al. | 340/573.1 |
| 2005/0248453 | A1 * | 11/2005 | Fechter | 340/539.15 |
| 2006/0232429 | A1 * | 10/2006 | Gonzalez | 340/573.1 |
| 2007/0182548 | A1 * | 8/2007 | Raad | 340/539.13 |
| 2007/0200716 | A1 * | 8/2007 | Haase et al. | 340/574 |
| 2008/0266116 | A1 * | 10/2008 | Hyatt | 340/573.4 |
| 2009/0212957 | A1 * | 8/2009 | Burris | 340/573.4 |
| 2009/0289844 | A1 * | 11/2009 | Palsgrove et al. | 342/357.07 |
| 2010/0117822 | A1 * | 5/2010 | Hyatt | 340/539.12 |

* cited by examiner

*Primary Examiner*—Julie Lieu
(74) *Attorney, Agent, or Firm*—Workman Nydegger

(57) ABSTRACT

A portable tracking alarm apparatus in a wrist watch configuration includes a main body and a strap. The main body includes a locator transmitter module, a micro-switch, and a trigger assembly. The strap is used for the user to wear, and has a hook that extends into the main body to hook the trigger assembly, such that the trigger assembly will not contact the micro-switch. When the strap is destroyed to cause the hook parting from the trigger assembly, the trigger assembly will touch and press the micro-switch to make the locator transmitter module emit a warning message.

10 Claims, 10 Drawing Sheets

PORTABLE TRACKING ALARM APPARATUS

CROSS-REFERENCE TO RELATED APPLICATIONS

This non-provisional application claims priority under 35 U.S.C. §119(a) on Patent Application No(s). 097211300 filed in Taiwan, R.O.C. on Jun. 25, 2008 the entire contents of which are hereby incorporated by reference.

BACKGROUND OF THE INVENTION

1. Field of Invention

The present invention relates to a tracking positioning apparatus, and more particularly, to a portable tracking alarm apparatus using a global positioning technique.

2. Related Art

Global Positioning System (GPS) is a positioning system developed by the US military, which employs 24 orbiting satellites devoted to providing reference for positioning, and satellite signal receivers to receive signals sent from the satellites so as to provide functions of navigation, positioning, and time transfer. In the early stage, the GPS is mainly used for the military purpose, and the application levels thereof are relatively limited. However, after the GPS is available for civil use, the popularization of the GPS is grown fast, and its application fields become increasingly diversified, which brings more and more convenience to people's life.

Currently, the GPS is widely used in fields, such as navigation and positioning for transportation tools like aircrafts, vessels, and vehicles, antitheft and monitoring of vehicles or articles, and positioning and communication for mountain climbing and adventurous activities. In various functions, the antitheft and monitoring function is closely related to people's daily life. Along with the industrialization of the social structure, various problems of public security occur, such as stealing and kidnapping. Therefore, products with a built-in satellite transmitter, for example, high-price vehicles, electronic products, and the like, emerge in the market, so that the articles after being stolen may be found by using the GPS, and the effect is positively approved. Furthermore, portable tracking positioning apparatuses are designed for the elder people and infants, such as wrist watches and mobile phones with a built-in satellite transmitter, for tracking those wearing the apparatuses when in danger or getting lost.

In practical use, the wrist watch is an accessory usually worn by the public, and is seldom taken off from the user, so the wrist watch is suitable to be used as a portable tracking positioning apparatus. The wrist watch tracking positioning apparatus may function as a common wrist watch for reading the time in normal situations. The wrist watch further has a transmit button installed at a certain position, and the user may press this button to make the built-in satellite transmitter send signals in emergency, so as to provide tracking positioning and warning messages to relevant departments, thus preventing accidental events. However, in some special circumstances that the wrist watch is taken off or destroyed before the user has time to press down the transmit button, the wrist watch tracking positioning apparatus cannot perform its predetermined functions, and this problem has not been properly paid attention to or solved. Therefore, the wrist watch tracking positioning apparatus currently available in the market is not perfectly designed, and fails to provide the desired protection for the user, so the wrist watch tracking positioning apparatus still needs improvement.

SUMMARY OF THE INVENTION

In view of the conventional wrist watch tracking positioning apparatus that loses the original function when taken off or destroyed, and is imperfect in emergent situations, the present invention is directed to a portable tracking alarm apparatus, capable of directly emitting a warning message to inform the relevant departments when taken off or destroyed.

Therefore, a portable tracking alarm apparatus including a main body and a strap is provided. The main body and the strap actually constitute a wrist watch capable of being worn by a user. The main body is substantially the body of the wrist watch, and the strap is substantially the belt of the wrist watch. The main body includes a locator transmitter module, a micro-switch, a trigger assembly, and an elastic member. The locator transmitter module is electrically connected to the micro-switch. The trigger assembly is pivoted to one side of the main body, and is disposed corresponding to the micro-switch. The elastic member is fitted on the trigger assembly, so as to normally push the trigger assembly to contact the micro-switch. One end of the strap is connected to the other side of the main body opposite to the trigger assembly, and the other end has a hook. The hook extends into the main body to hook the trigger assembly, such that the strap encloses a loop range at one side of the main body for wearing, and a distance is maintained between the trigger assembly and the micro-switch. The elastic member drives the trigger assembly to press the micro-switch when the hook is off, such that the micro-switch generates a transmitting signal. The locator transmitter module then receives the transmitting signal from the micro-switch to emit a warning message.

The present invention achieves the effect of making the elastic member drive the trigger assembly to press the micro-switch in the situation that the hook releases the trigger assembly when the strap is taken off or destroyed, and thus the locator transmitter module emits a warning message. This mechanism effectively enables the portable tracking alarm apparatus to automatically emit a warning message when taken off or destroyed as the user encounters a danger or an accidental event.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
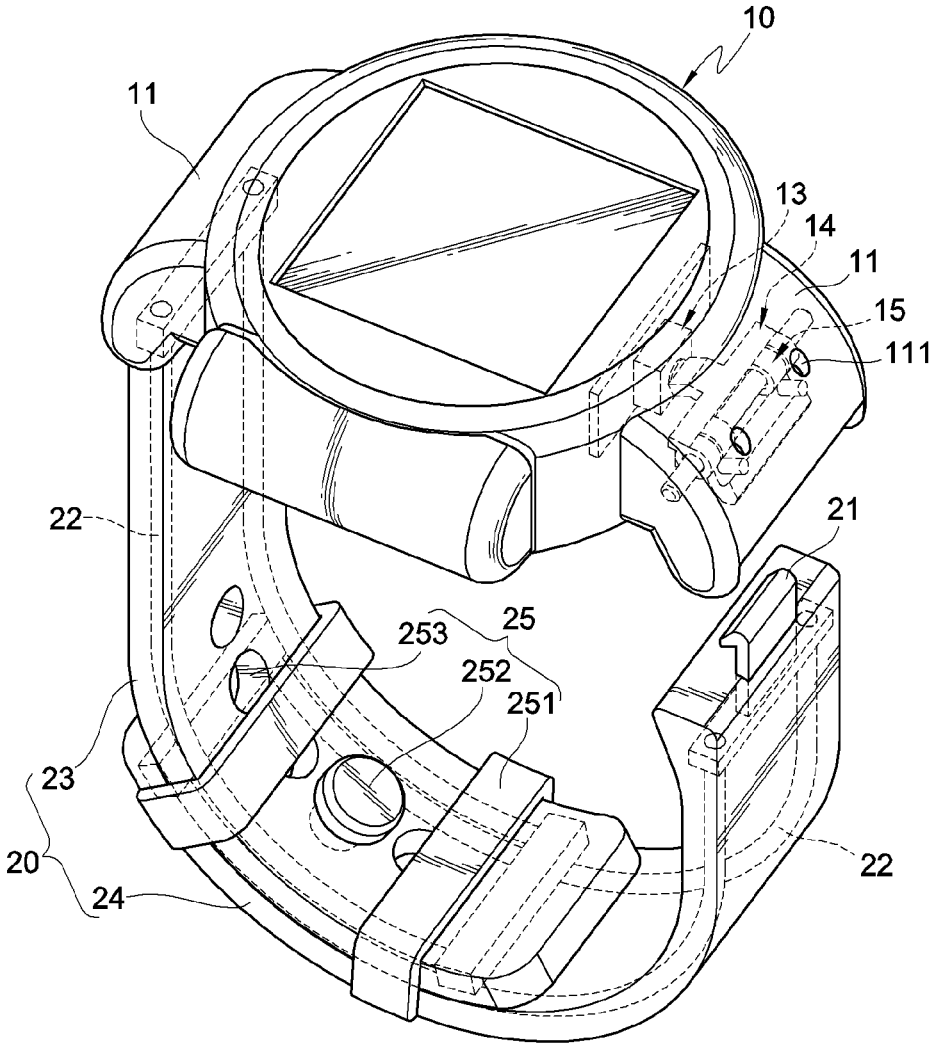
FIG. 1 is a perspective view of a strap separated from a main body according to a first embodiment of the present invention.
Figure 2:
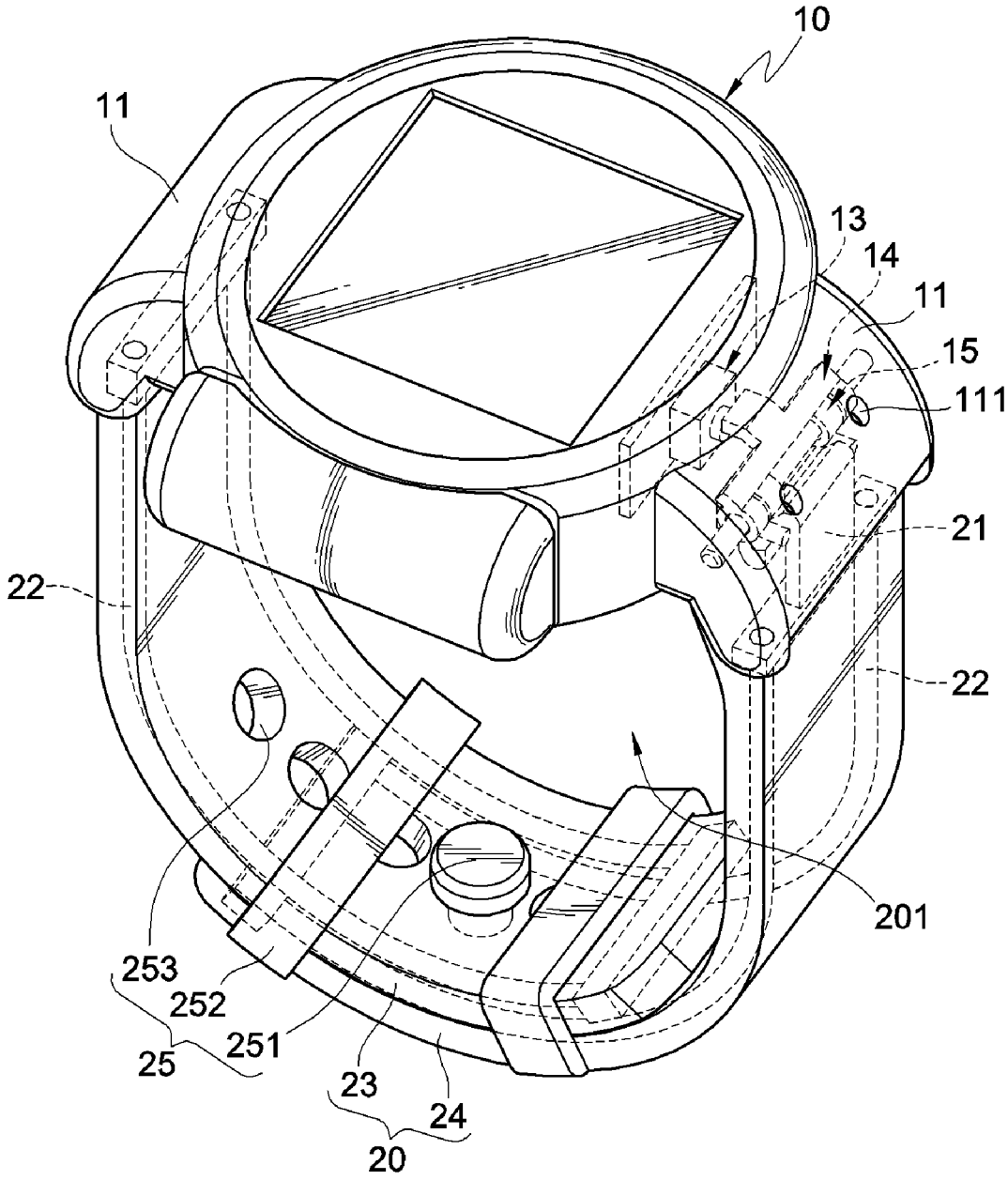
FIG. 2 is a perspective view of the strap buckled on the main body according to the first embodiment of the present invention.
Figure 3:
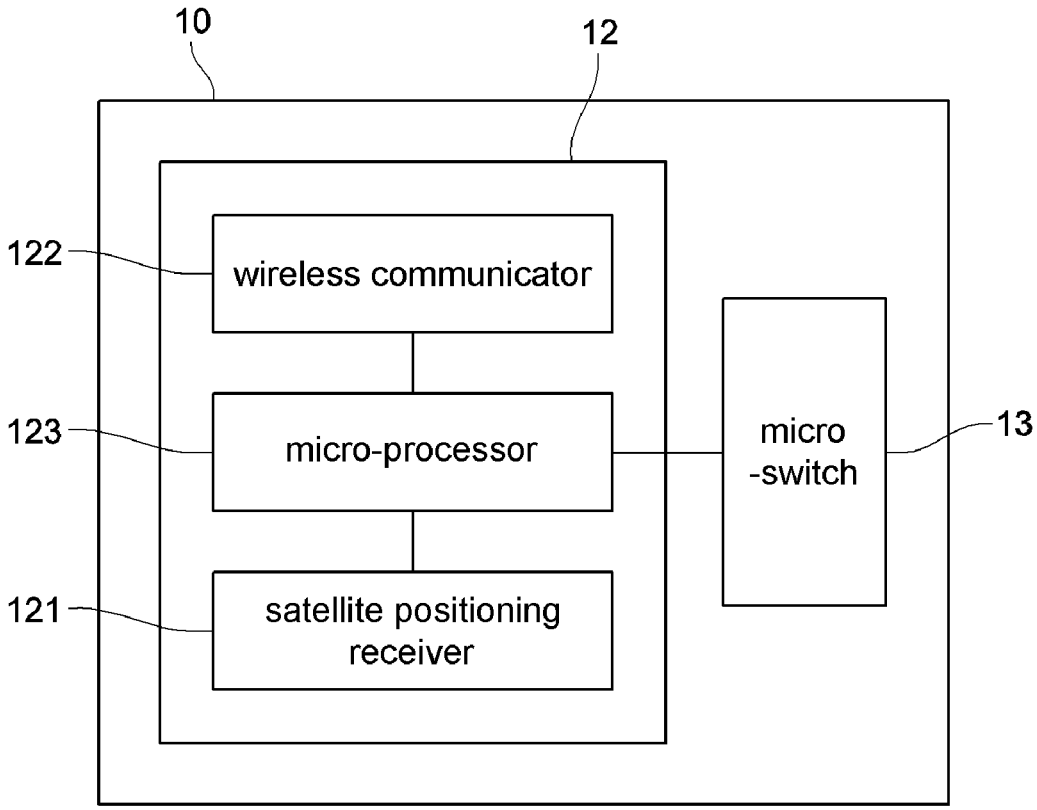
FIG. 3 is a block view of internal components of the main body according to the present invention.

The objectives, structures, features, and functions of the present invention will be illustrated in detail below in the accompanying embodiments.

Referring to FIGS. 1 to 8, a first embodiment of the portable tracking alarm apparatus of the present invention is shown. The portable tracking alarm apparatus in the first embodiment includes a main body 10 and a strap 20. The main body 10 and the strap 20 actually constitute a wrist watch capable of being worn by a user (on the wrist). The main body 10 is substantially the body of the wrist watch, and the strap 20 is substantially the belt of the wrist watch.

Referring to FIGS. 1, 2, 3, 4, and 5, the main body 10 is a flat case with a hollow interior provided for installing components of a common wrist watch. The main body 10 has two opposite connecting portions 11 on two sides. The main body 10 further includes a locator transmitter module 12, a micro-switch 13, a trigger assembly 14, and an elastic member 15. The locator transmitter module 12 is installed in the main body 10, the trigger assembly 14 and the elastic member 15 are installed in one of the two connecting portions 11, and the micro-switch 13 is installed between the connecting portion 11 and the main body 10.

When the trigger assembly 14 contacts the micro-switch 13, the micro-switch 13 generates a transmitting signal. The locator transmitter module 12, electrically connected to the micro-switch 13, includes a satellite positioning receiver 121, a wireless communicator 122, and a micro-processor 123. The satellite positioning receiver 121 is used for receiving a satellite positioning information, i.e. receiving a satellite signal from the GPS, so as to position the location (latitude, longitude, and altitude) of the portable tracking alarm apparatus. The wireless communicator 122 is a communicator capable of transmitting data through wireless signals, for example, through wireless networks, radio signals, and satellite signals. The micro-processor 123 is electrically connected to the micro-switch 13, the satellite positioning receiver 121, and the wireless communicator 122. In addition, the micro-processor 123 receives the transmitting signal from the micro-switch 13 and the satellite positioning information from the satellite positioning receiver 121, and controls the wireless communicator 122 to emit a warning message containing the satellite positioning information.

The trigger assembly 14 is pivoted to one side of the main body 10, and is disposed corresponding to the micro-switch 13. The trigger assembly 14 has a shaft portion 141, a contact portion 142, a hook portion 143, and two trigger portions 144. The contact portion 142 and the hook portion 143 are respectively located on two ends of the shaft portion 141. The trigger assembly 14 is pivoted to the connecting portion 11 of the main body 10 through the shaft portion 141, and the contact portion 142 is made to face the micro-switch 13. The contact portion 142 presses the micro-switch 13, such that the micro-switch 13 actuates to generate a transmitting signal. The trigger portions 144 and the hook portion 143 are disposed on the same end. Two perforations 111 are opened in the connecting portion 11 of the main body 10, and respectively disposed corresponding to the trigger portions 144 of the trigger assembly 14.

The elastic member 15 is fitted on the trigger assembly 14 to normally push the contact portion 142 of the trigger assembly 14 to contact the micro-switch 13. In this embodiment, the elastic member 15 is a flat spring having a curved middle section deformed to provide an elastic force. One end of the elastic member 15 urges against an embossed sheet of the main body 10, and the other end urges against the hook portion 143 of the trigger assembly 14. The elastic member 15 may be a torsion spring or other elastic articles, as long as it can normally push the trigger assembly 14 in the direction of the micro-switch 13.

Referring to FIGS. 1, 2, 3, 4, 5, and 6, the strap 20 is a flat belt having one end connected to the other side of the main body 10 opposite to the trigger assembly 14, and the other end provided with a hook 21. One end of the strap 20 is pivoted to the connecting portion 11 not having the trigger assembly 14, and the trigger assembly 14 and the elastic member 15 are installed in the other connecting portion 11 of the main body 10. The hook 21 of the strap 20 may be inserted into the connecting portion 11 having the trigger assembly 14. The hook 21 extends into the connecting portion 11 of the main body 10 to hook the trigger assembly 14, such that the strap 20 encloses a loop range 201 at one side of the main body 10 for the user to wear on the wrist.

When the user wears the main body 10 through the strap 20, i.e., the hook 21 hooks the trigger assembly 14, the hook 21 may catch the hook portion 143 of the trigger assembly 14, such that a distance is maintained between the contact portion 142 of the trigger assembly 14 and the micro-switch 13. When the hook 21 catches the hook portion 143 of the trigger assembly 14, the elastic member 15 is twisted and deformed to produce an elastic force to push the trigger assembly 14 to sway towards the micro-switch 13. When the hook 21 releases the hook portion 143 of the trigger assembly 14, the elastic member 15 drives the trigger assembly 14 to press the micro-switch 13, so that the micro-switch 13 generates the aforementioned transmitting signal.

The strap 20 includes a connection belt 23, a buckling belt 24, and an adjusting member 25 facing the loop range 201. One end of the connection belt 23 is pivoted to the connecting portion 11 of the main body 10, and the adjusting member 25 is disposed between the connection belt 23 and the buckling belt 24. The hook 21 is disposed on one end of the buckling belt 24, and the adjusting member 25 is disposed on the other end of the buckling belt 24. The adjusting member 25, used for adjusting the loop range 201, includes two limiting loops 251, an embedded block 252 disposed between the limiting loops 251, and a plurality of positioning holes 253.

In this embodiment, the limiting loops 251 and the embedded block 252 are disposed on the other end of the buckling belt 24 opposite to the hook 21, and the positioning holes 253 are opened in the connection belt 23. The connection belt 23 passes through the limiting loops 251, and the embedded block 252 is embedded into one of the positioning holes 253, so as to combine the connection belt 23 with the buckling belt 24 and adjust the loop range 201 by embedding the embedded block 252 respectively into the positioning holes 253. The buckling belt 24 and the connection belt 23 have two steel wires 22 embedded therein. Each steel wire 22 extends to surround the loop range 201, and one end of the steel wire 22 of the buckling belt 24 is connected to the hook 21.

In addition, in the present invention, the positions of the limiting loops 251, the embedded block 252, and the positioning holes 253 may be exchanged. That is, the limiting loops 251 and the embedded block 252 are disposed on the connection belt 23, and the positioning holes 253 are disposed in the buckling belt 24. Accordingly, the buckling belt 24 passes through the limiting loops 251, and the embedded block 252 is embedded into one of the positioning holes 253, so as to combine the connection belt 23 with the buckling belt 24 and adjust the loop range 201 by embedding the embedded block 252 respectively into the positioning holes 253. The manner for exchanging the positions of the adjusting member 25 is easy to understand, and will not be shown in the figure.

Figure 4:
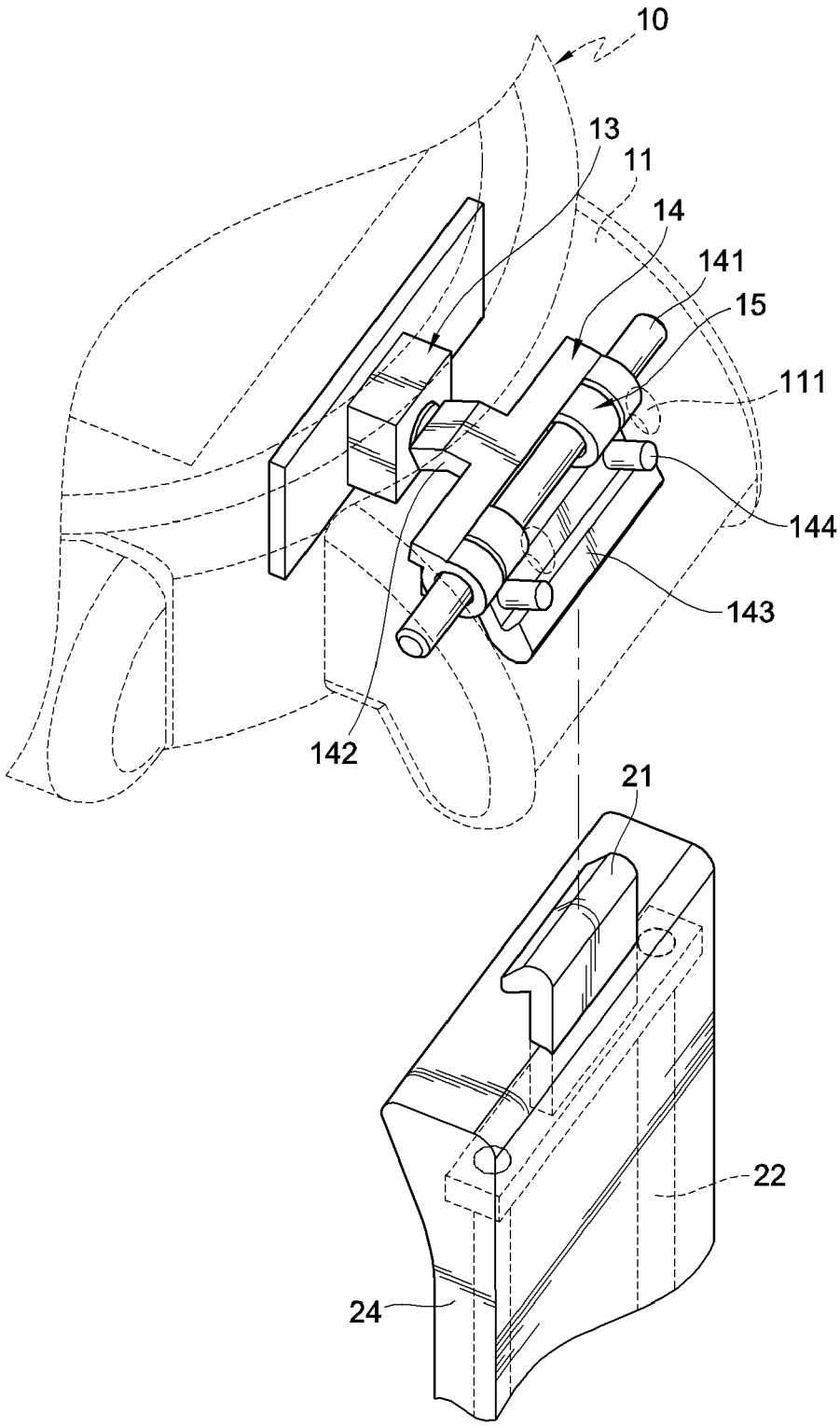
FIG. 4 is a partial perspective view of the strap separated from the main body according to the first embodiment of the present invention.
Figure 5:
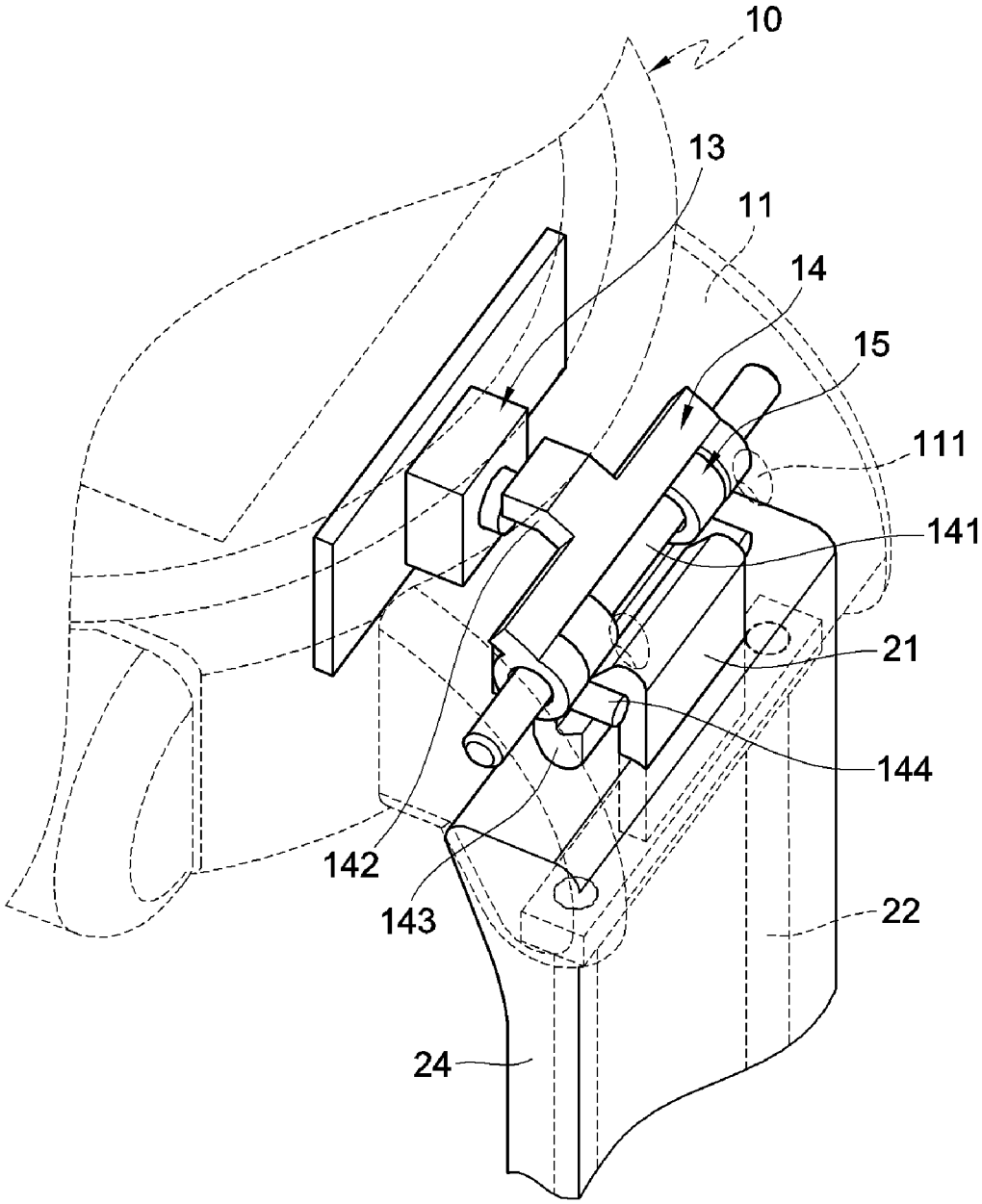
FIG. 5 is a partial perspective view of the strap buckled on the main body according to the first embodiment of the present invention.
Figure 6:
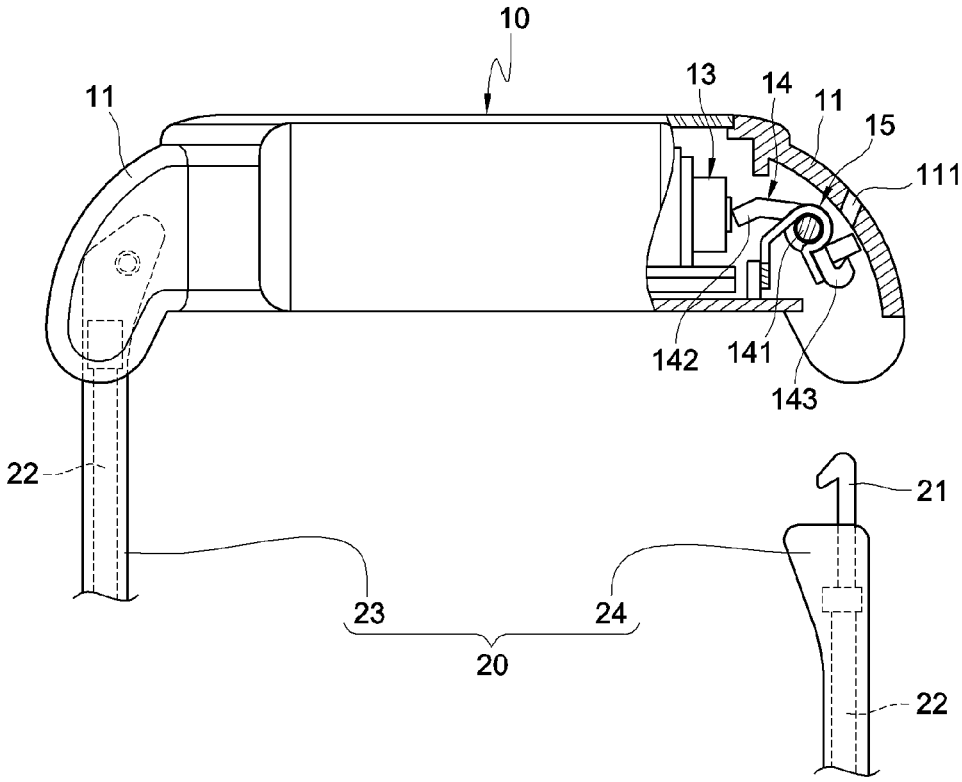
FIG. 6 is a cross-sectional view of the strap separated from the main body according to the first embodiment of the present invention.
Figure 7:
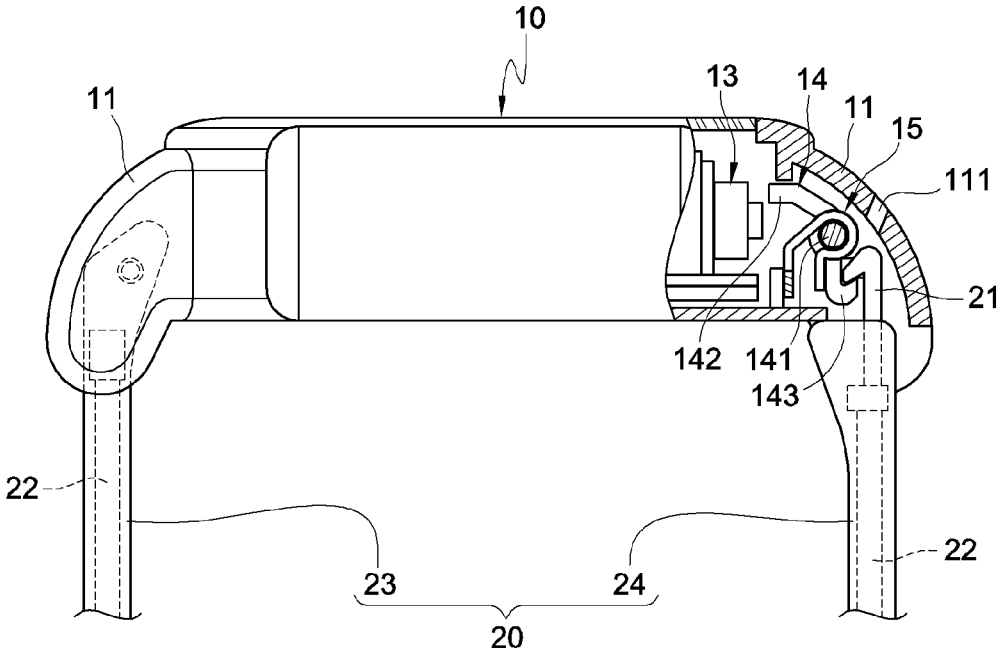
FIG. 7 is a cross-sectional view of the strap buckled on the main body according to the first embodiment of the present invention.
Figure 8:
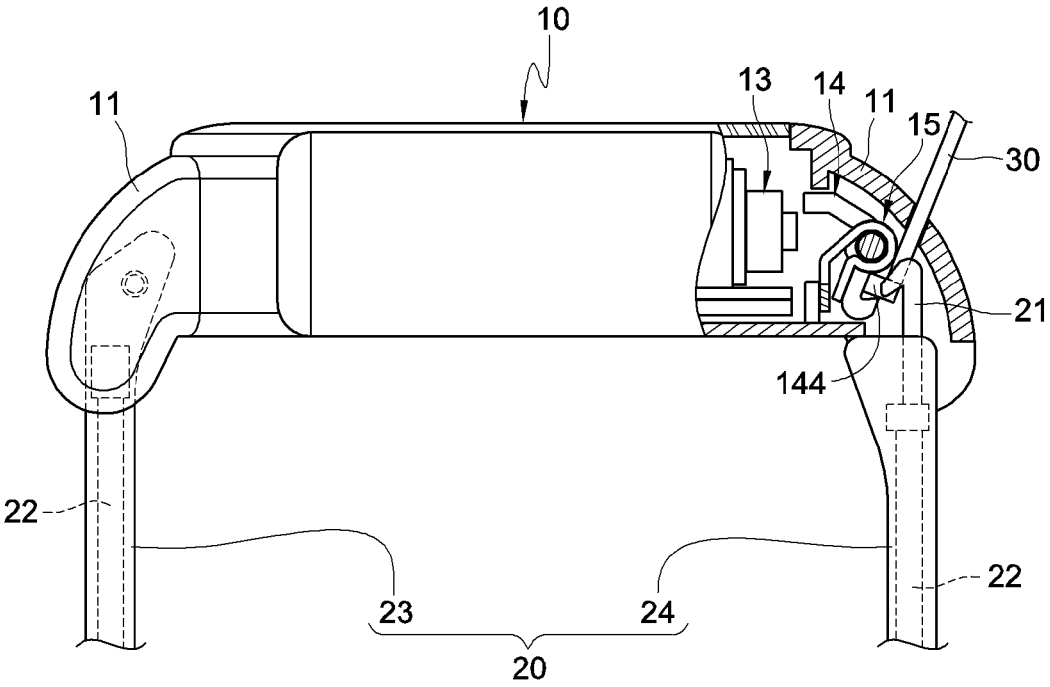
FIG. 8 is a cross-sectional view of the strap released in the main body according to the first embodiment of the present invention.

Referring to FIGS. 4, 5, 6, 7, and 8, before the user wears the portable tracking alarm apparatus of the present invention, the adjusting member 25 adjusts the appropriate loop range 201. At this time, the main body 10 assumes an initial state (as shown in FIGS. 4 and 6). Although the trigger assembly 14 continues to press the micro-switch 13, the micro-switch 13 will not generate the transmitting signal. Once the trigger assembly 14 departs from the micro-switch 13, the main body 10 enters a sensing state (as shown in FIGS. 5 and 7), and as long as the trigger assembly 14 presses the micro-switch 13 again, the micro-switch 13 will generate the transmitting signal. This mode switching may be controlled by the firmware and the micro-processor 123 built in the main body 10. Definitely, a switching button disposed on the main body 10 may also be used for the user to press to switch the initial state and the sensing state.

After adjusting the appropriate loop range 201, the user places the main body 10 on the wrist, and then winds the strap 20 around the wrist to insert the hook 21 into the connecting portion 11 of the main body 10, such that the hook 21 hooks the trigger assembly 14. Then, the trigger assembly 14 sways to depart from the micro-switch 13, and thus the main body 10 switches from the initial state into the sensing state. Now, the user finishes the procedures of wearing the portable tracking alarm apparatus of the present invention. After that, once the portable tracking alarm apparatus is taken off from the wrist of the user, i.e., the user encounters a danger, the elastic member 15 pushes the trigger assembly 14 to sway and press the micro-switch 13, and the micro-processor 123 accordingly controls the wireless communicator 122 to emit the aforementioned warning message to relevant departments. Intending to detach the portable tracking alarm apparatus of the present invention on his/her own, the user may use a rod-like release member 30 to pass through the perforations 111 of the connecting portion to push the trigger portions 144, such that the trigger assembly 14 sways outwards to make the hook 21 release the trigger assembly 14.

In addition, since the connection belt 23 and the buckling belt 24 of the strap 20 respectively have a steel wire 22 embedded therein, the portion of the trigger assembly 14 caught by the hook 21 becomes a weak portion in the structure of the portable tracking alarm apparatus. Even if the strap 20 is forcedly destroyed under an external force, the hooking relation between the destroyed hook 21 and the trigger assembly 14 will be affected first. Thereby, the elastic member 15 pushes the trigger assembly 14 to sway and press the micro-switch 13, and the micro-processor 123 thus controls the wireless communicator 122 to emit the warning message accordingly.

Figure 9:
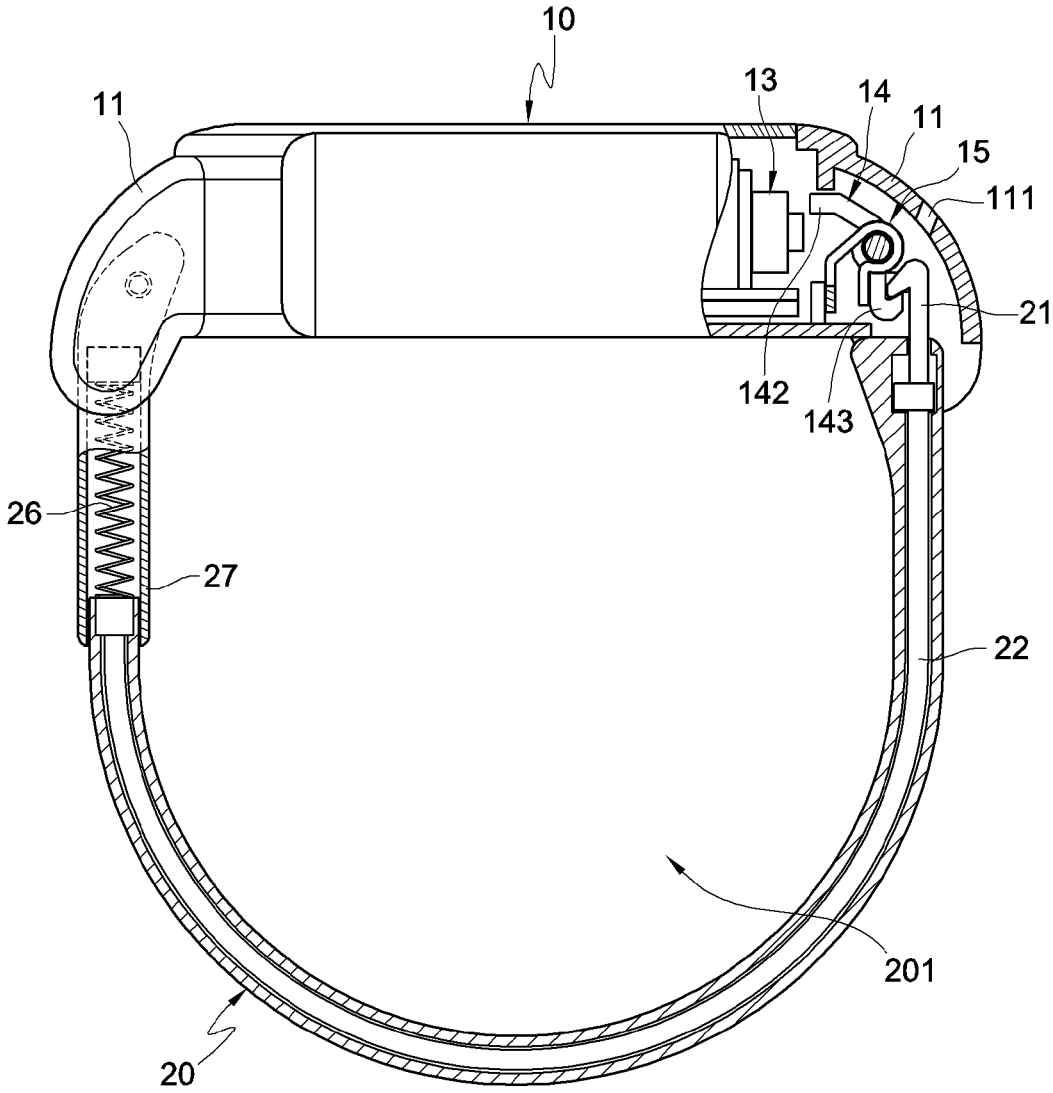
FIG. 9 is a cross-sectional view of a strap buckled on a main body according to a second embodiment of the present invention.
Figure 10:
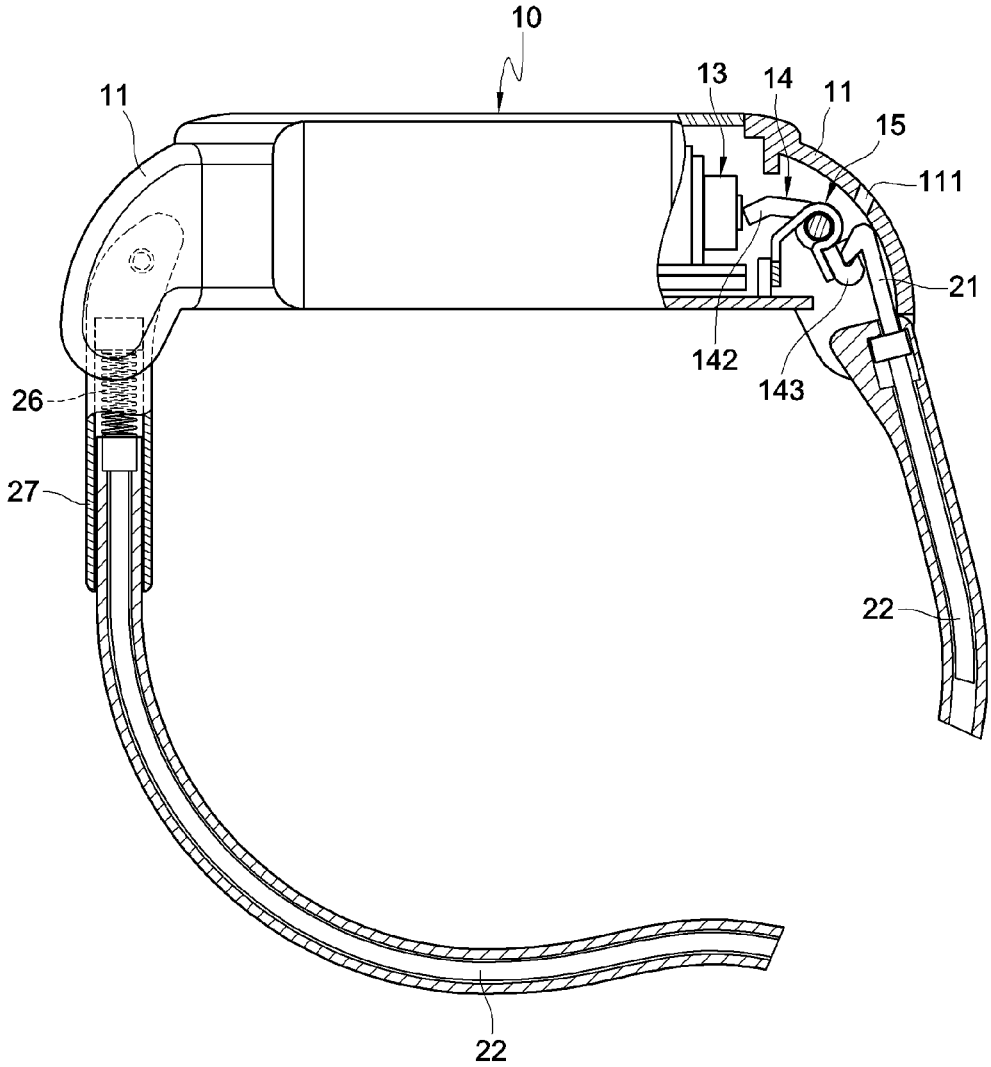
FIG. 10 is a cross-sectional view of the strap when destroyed according to the second embodiment of the present invention.

Referring to FIGS. 9 and 10, a second embodiment of the portable tracking alarm apparatus of the present invention is shown. The portable tracking alarm apparatus in the second embodiment includes a main body 10 and a strap 20. The construction of the main body 10 is substantially the same as that of the first embodiment, and the strap 20 adopts another structure.

In this embodiment, one end of the strap 20 is pivoted to the connecting portion 11 of the main body 10, and the strap 20 has two movable steel wires 22 embedded therein and an extensible extension spring 26. The strap 20 further has a hook 21 and a protection sheath 27. The hook 21 slides along the strap 20 to change the extending length. One end of the steel wire 22 is connected to the hook 21, and the other end is connected to the extension spring 26. One end of the protection sheath 27 is connected to the portion of the strap 20 pivoted to the main body 10, and covers the extension spring 26 and a portion of the strap 20. The user may pull the strap 20 to stretch the extension spring 26, and make the strap 20 and the steel wires 22 slide relative to the protection sheath 27, so as to adjust the loop range 201 and directly wear the portable tracking alarm apparatus on the wrist.

When the hook 21 extends into the connecting portion 11 of the main body 10 to hook the trigger assembly 14, the extension spring 26 pulls the steel wires 22, so that the hook 21 maintains the state of hooking the trigger assembly 14, and the main body 10 enters the sensing state. Afterward, once the portable tracking alarm apparatus is taken off from the wrist of the user or the strap is forcedly destroyed under an external force (as shown in FIG. 10), the hook 21 may not continue hooking the trigger assembly 14. Thereby, the elastic member 15 pushes the trigger assembly 14 to sway and press the micro-switch 13, and the micro-processor 123 thus controls the wireless communicator 122 to emit the warning message accordingly.

The present invention enables the elastic member to drive the trigger assembly to press the micro-switch when the hook releases the trigger assembly in circumstances that the strap is taken off or destroyed, and thus the locator transmitter module emits a warning message. This mechanism effectively enables the portable tracking alarm apparatus to automatically emit a warning message when taken off or destroyed as the user encounters a danger or an accidental event.

What is claimed is:

1. A portable tracking alarm apparatus, comprising:

a main body, comprising a locator transmitter module, a micro-switch, a trigger assembly, and an elastic member, wherein the locator transmitter module is electrically connected to the micro-switch, the trigger assembly is pivoted to the main body and is disposed corresponding to the micro-switch, and the elastic member is fitted on the trigger assembly, so as to normally push the trigger assembly to contact the micro-switch; and a strap, having one end connected to the other side of the main body opposite to the trigger assembly, and the other end provided with a hook extending into the main body to hook the trigger assembly, such that the strap encloses a loop range at one side of the main body for wearing, and a distance is maintained between the trigger assembly and the micro-switch, wherein the elastic member drives the trigger assembly to press the micro-switch when the hook is off, such that the micro-switch generates a transmitting signal, and the locator transmitter module receives the transmitting signal to emit a warning message.

2. The portable tracking alarm apparatus according to claim 1, wherein the locator transmitter module comprises:

a satellite positioning receiver, for receiving a satellite positioning information;

a wireless communicator; and a micro-processor, electrically connected to the micro-switch, the satellite positioning receiver, and the wireless communicator, wherein the micro-processor receives the transmitting signal and the satellite positioning information, and controls the wireless communicator to emit the warning message containing the satellite positioning information.

3. The portable tracking alarm apparatus according to claim 1, wherein the main body has two opposite connecting portions, one end of the strap is pivoted to one connecting portion, the trigger assembly and the elastic member are installed in the other connecting portion, and the hook at the other end of the strap is inserted in the same connecting portion.

4. The portable tracking alarm apparatus according to claim 3, wherein the trigger assembly has at least one trigger portion, the connecting portion has at least one perforation corresponding to the trigger portion, and a release member passes through the perforation to push the trigger portion, such that the trigger assembly sways outwards to make the hook release the trigger assembly.

5. The portable tracking alarm apparatus according to claim 1, wherein the strap has at least one movable steel wire and at least one extension spring embedded therein, one end of the steel wire is connected to the hook and the other end is connected to the extension spring, and the extension spring pulls the steel wire, such that the hook sustains the state of hooking the trigger assembly.

6. The portable tracking alarm apparatus according to claim 1, wherein the strap comprises a connection belt pivoted to the main body, a buckling belt, and an adjusting member disposed between the connection belt and the buckling belt while facing the loop range, the hook is disposed on one end of the buckling belt, and the adjusting member is disposed on the other end of the buckling belt, so as to adjust the loop range.

7. The portable tracking alarm apparatus according to claim 6, wherein the adjusting member comprises two limiting loops, an embedded block disposed between the two limiting loops, and a plurality of positioning holes, the limiting loops and the embedded block are disposed on the other end of the buckling belt opposite to the hook, and the positioning holes are opened in the connection belt, the connection belt passes through the limiting loops, and the embedded block is embedded into one of the positioning holes, so as to combine the connection belt with the buckling belt and adjust the loop range by embedding the embedded block respectively into the positioning holes.

8. The portable tracking alarm apparatus according to claim 6, wherein the adjusting member has two limiting loops, an embedded block disposed between the limiting loops, and a plurality of positioning holes, the positioning holes are opened in the buckling belt, and the limiting loops and the embedded block are disposed on the connection belt, the buckling belt passes through the limiting loops, and the embedded block is embedded into one of the positioning holes, so as to combine the connection belt with the buckling belt and adjust the loop range by embedding the embedded block respectively into the positioning holes.

9. The portable tracking alarm apparatus according to claim 6, wherein the buckling belt has a steel wire embedded therein, and the steel wire is connected to the hook and extends to surround the loop range.

10. The portable tracking alarm apparatus according to claim 6, wherein the connection belt has a steel wire embedded therein, and the steel wire extends to surround the loop range.

* * * * *